United States Patent [19]

Schmidt

[11] Patent Number: 4,862,867

[45] Date of Patent: Sep. 5, 1989

[54] ARROW RETAINER FOR ARCHERY

[76] Inventor: John M. Schmidt, 19653 Landcaster, Harper Woods, Mich. 48225

[21] Appl. No.: 11,204

[22] Filed: Feb. 2, 1987

[51] Int. Cl.[4] ..... F41D 10/00

[52] U.S. Cl. ..... 124/41 A; 124/88

[58] Field of Search ..... 124/41, 86, 88, 24 R, 124/22

[56] References Cited

U.S. PATENT DOCUMENTS

| | | | |
|---|---|---|---|
| 3,406,675 | 10/1968 | Fredrickson | 124/24 R |
| 3,919,997 | 11/1975 | Day | 124/24 R |
| 4,038,960 | 8/1977 | Ludwig | 124/41 A |
| 4,282,850 | 8/1981 | Warnicke | 124/24 R |
| 4,372,282 | 2/1983 | Sanders | 124/41 A |
| 4,577,612 | 3/1986 | Zell | 124/41 A |
| 4,662,346 | 5/1987 | Laffin | 124/24 R |

*Primary Examiner*—Edward M. Coven
*Assistant Examiner*—Mark S. Graham
*Attorney, Agent, or Firm*—Harness, Dickey & Pierce

[57] ABSTRACT

An arrow retainer to be attached to an archery bow which retains the arrow in a position adjacent the arrow rest. In accordance with this invention, the arrow retainer is preferably made from elastomeric materials and forms an upwardly opening channel. The arrow retainer provides a restricted distance gap enabling an arrow to be loaded within an area adjacent the bow arrow rest. The confined area defined by the arrow retainer maintains the arrow in close proximity with the arrow rest, thereby minimizing the time necessary to draw and release the arrow. In accordance with an alternate embodiment of this invention, the arrow retainer is integrated into the arrow rest component.

6 Claims, 2 Drawing Sheets

ARROW RETAINER FOR ARCHERY

BACKGROUND OF THE INVENTION

This invention relates to a passive arrow retainer adapted to be mounted to an archery bow particularly useful for retaining an arrow near a proper position for shooting from the bow.

In order to properly and accurately shoot an arrow from an archery bow, it is necessary to insure that the arrow is resting at a predetermined position with respect to the bow. Modern archery bows are provided with a horizontally extending arrow rest which the arrow bears against prior to release. Arrow rests are designed to minimize their interference with the arrow and its fletchings as the arrow is released. Accordingly, arrow rests are typically no more than a flat platform or post which requires that the archer carefully position the arrow on the rest.

Sometimes it is difficult for an archer to maintain the arrow on the arrow rest. For example, beginner archers sometimes fail to exert the proper force on the arrow nock by the releasing fingers to maintain the arrow in the proper position. Even experienced archers encounter difficulties in this regard. Bow hunters are often required to wait for prolonged periods of time before shooting only to find that when the game finally appears they have failed to insure that the arrow is properly positioned with respect to the bow. Often hunters must move through brush which can cause the arrow to be moved from its proper position. Thus, archers would benefit from an arrow guide which maintains the arrow in a position near the arrow rest. Such a device would simplify archery for beginners and would reduce fatigue of hunters and help ensure that hunters are ready to draw and release the arrow when game appears.

In accordance with this invention, an arrow retainer is provided which is attachable to an archery bow and serves to maintain the arrow in close proximity with the arrow rest. The arrow retainer according to this invention is easy to use and does not interfere with the release or free flight of the arrow. Furthermore, the arrow retainer can be integrated with an arrow rest. Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 6 is a rear elevational view similar to FIG. 2 but showing a third embodiment of the present invention;

DETAILED DESCRIPTION OF THE INVENTION

Figure 1:
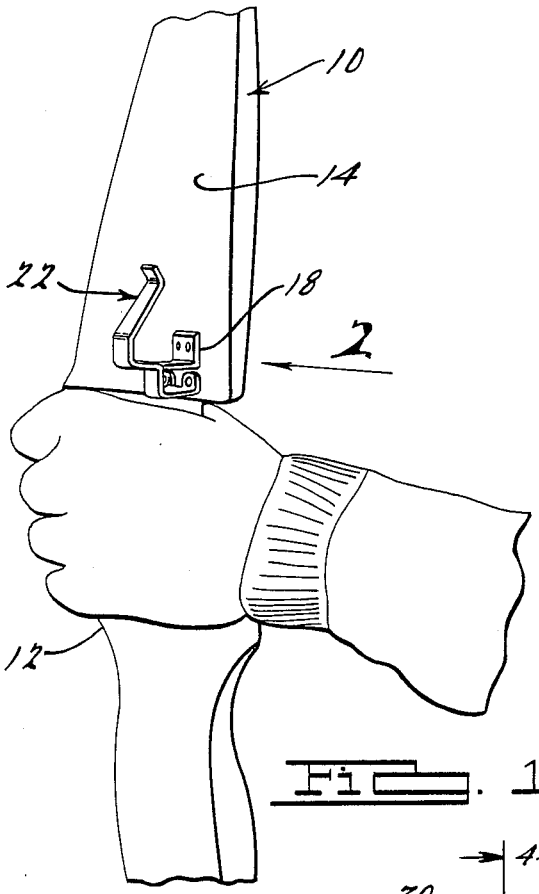
FIG. 1 is a partial pictorial view of a representative archery bow showing an arrow retainer in accordance with a first embodiment of the present invention and further showing a conventional arrow rest.
Figure 2:
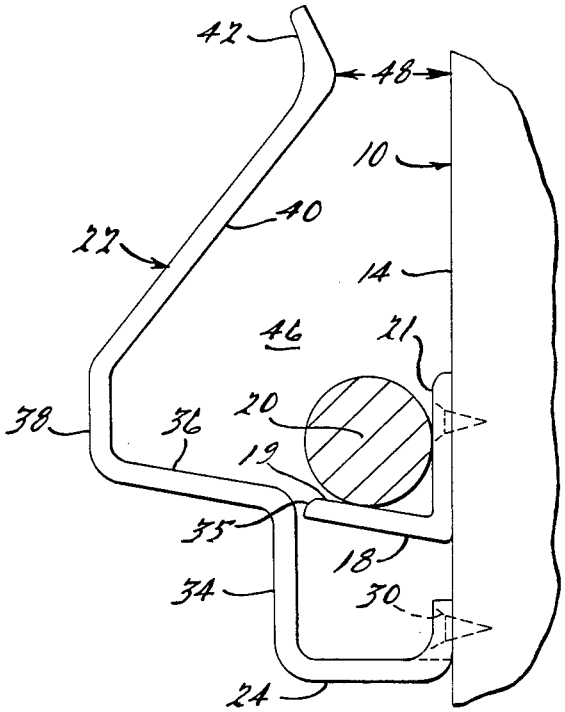
FIG. 2 is a rear elevational view taken in the direction of arrow 2 of FIG. 1 showing the arrow retainer, arrow rest with an arrow shown in transverse section thereon and a portion of the bow.
Figure 3:
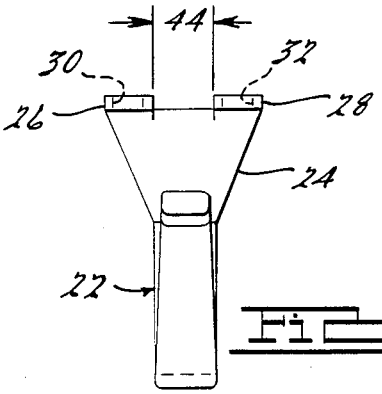
FIG. 3 is a plan view of the arrow retainer of FIGS. 1–2.
Figure 4:
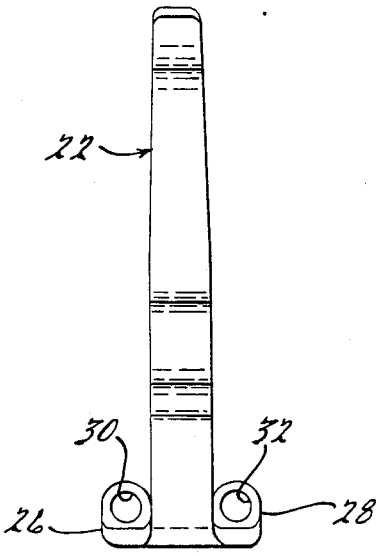
FIG. 4 is a side elevational view of the arrow retainer of FIGS. 1–3.

FIG. 1 illustrates a conventional archery bow 10 having a handle portion 12 shown being grasped by a user, a sight window area 14 located above handle portion 12, and an arrow rest 18 fastened to bow 10 in the region of sight window 14. Arrow 20 rests against generally horizontal surface 19 and generally vertical surface 21 of arrow rest 18.

FIGS. 1 through 4 illustrate arrow retainer 22 in accordance with a first embodiment of this invention. Arrow retainer 22 has laterally extending mounting leg 24 with a pair of pads or feet 26 and 28 with mounting holes 30 and 32 which enable arrow retainer 22 to be securely fastened to bow 10 using threaded fasteners such as screws 30. It will, of course, be appreciated that arrow retainer 22 could be less preferably mounted to bow 10 with only one foot and fastener. Arrow guide 22 has a number of leg segments. Upwardly extending leg segment 34 extends vertically from mounting leg 24 to a position proximate to the terminal end 35 of arrow rest 18. Laterally extending leg segment 36 extends away from arrow rest 18 with its upper surface along a plane generally coplanar with the upper surface 19 of arrow rest 18. Preferably, leg segment 36 is inclined slightly such that it rises as it extends farther from bow 10 so that an arrow resting on leg segment 36 will tend to move rightward as viewed in FIG. 2. Leg segment 38 extends upwardly from leg 36 and transitions to leg segment 40 which extends generally upwardly and inwardly towards bow 10. Leg segment 40 transitions to out-turned leg segment 42 which defines the distal end of arrow guide 22. Preferably, arrow retainer 22 is made of flexible material and the inside surface of arrow retainer 22 at the junction between leg segments 40 and 42 is spaced from sight window 14 by resistance gap 48 which is slightly less than the diameter of arrow 20. Leg segments 36, 38 and 40 cooperate with arrow rest 18 and bow 10 to define area 46 within which an arrow may be retained, as described in detail below.

Arrow retainer 22 can be made of aluminum steel, brass, or any suitable material but is preferably formed from a polymeric plastic material which is fairly resilient. In order to enable arrow retainer 22 to be inexpensively produced by injection molding processes, pads 26 and 28 are preferably separated by gap 44 which is wider than leg segment 34. Such configuration, best shown in FIG. 3, would enable the component to be made by die halves which part along a generally vertical line, with respect to the orientation of arrow guide 22 shown in FIG. 2. In this manner, die portions which form leg segment 34 can be pulled from the molded part through gap 44.

In use, arrow 20 is positioned inside area 46 by pushing it downwardly through gap 48, thereby deflecting arrow retainer 22. Once arrow 20 is disposed within area 46, it is free to move therein, but is nevertheless maintained in close proximity with arrow rest 18. When the archer is preparing to draw and release the arrow, it is quickly guided into its proper position on arrow rest 18. Such positioning is facilitated by the fact that leg segment 36 is oriented so that the arrow can slide onto arrow rest 18. Once arrow 20 is released, the configuration of arrow retainer 22 permits the arrow to freely pass through the open area 46.

Figure 5:
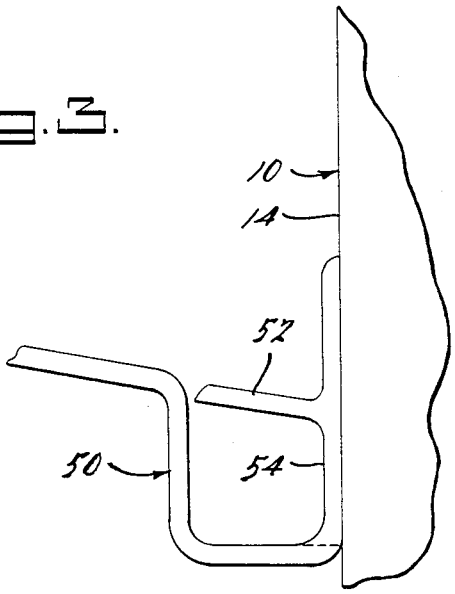
FIG. 5 is a partial rear elevational view similar to FIG. 2 but showing an arrow retainer in accordance with a second embodiment of the present invention.

FIG. 5 illustrates a second embodiment according to this invention wherein arrow retainer 50 incorporates arrow rest 52. This integration is achieved by extending mounting leg 54 vertically upward to form arrow rest 52. This integration of arrow retainer 50 with arrow rest 52 simplifies mounting of both components to bow 10.

Figure 7:
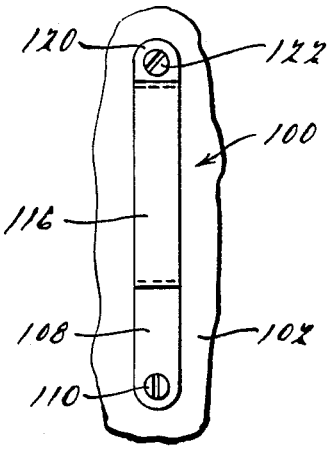
FIG. 7 is a side elevational view of the embodiment of FIG. 6.

Now referring to FIGS. 6 and 7, another alternative embodiment of the present invention is illustrated and indicated generally by numeral 100. Arrow retainer 100 is shown mounted on a bow 102 having an arrow rest 104 formed as a shoulder above handle portion 106. Arrow retainer 100 has vertically extending leg 108 attached to bow 102 by threaded fastener 110 which extends through a suitable aperture in leg 108. Vertical leg 108 transitions to lower horizontal leg 112 proximate to distal end 113 of arrow rest 104. Lower horizontal leg 112 extends away from bow 102 and has an upper surface 114 which lies generally coplanar with the upper surface of arrow rest 104. Horizontal leg 112 transitions to vertical leg 116 which transitions to upper horizontal leg 118 which extends to bow 102 and is fastened thereto at foot 120 by a threaded fastener 122 which extends through a suitable aperture in foot 120. Legs 112, 116, and 118 define with arrow rest 104 and bow 102 an area 124 for arrow retention. It will be appreciated that, in use, arrows must be "threaded" through area 124 as in threading a needle and cannot be dropped through a gap such as gap 48 as in the first and second embodiments of this invention.

Figure 8:
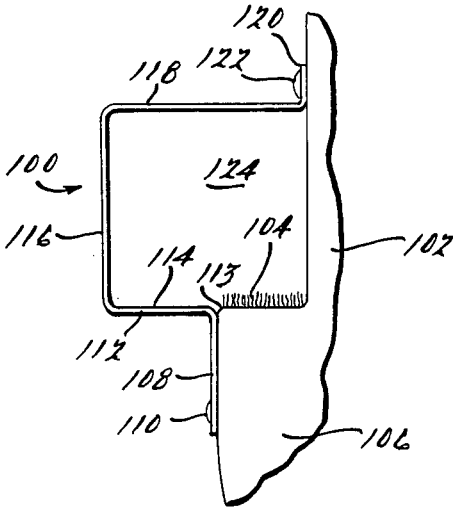
FIG. 8 is a rear elevational view similar to FIG. 2 but showing a fourth embodiment of the present invention.
Figure 9:
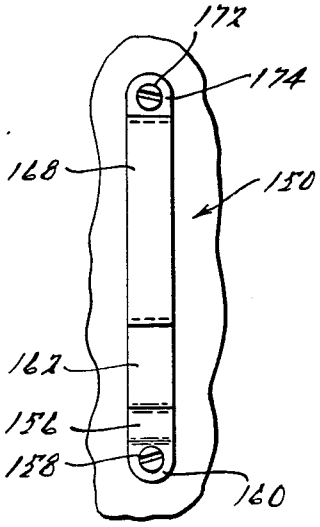
FIG. 9 is a side elevational view of the embodiment of FIG. 8.
Figure 8:
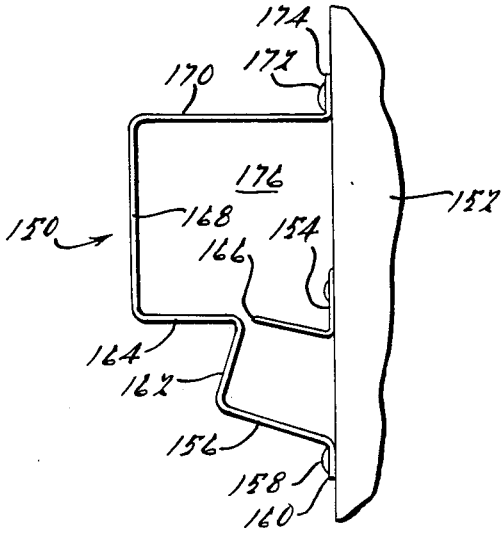

FIGS. 8 and 9 illustrate another alternate arrow retainer of the present invention indicated generally by the numeral 150. Arrow retainer 150 is shown mounted on a bow 152 having a separate arrow rest 150 attached thereto. Arrow retainer 150 has a lower leg 156 attached to bow 152 by a threaded fastener 158 which extends through a suitable aperture in foot 160 of lower leg 156. Lower leg 156 extends generally horizontally and upwardly away from bow 152 and transitions to a first generally vertical reentrant leg 162 which transitions to a generally horizontal leg 164 proximate to the distal end 166 of arrow rest 154. Second horizontal leg 164 extends away from bow 152 and transitions to a generally vertical leg 168 which transitions to an upper generally horizontal leg 170 which extends to bow 152 and is fastened thereto by a threaded fastener 172 which extends through a suitable aperture in foot 174 of upper horizontal leg 170. Legs 164, 168 and 170 cooperate with arrow rest 154 and bow 152 to define area 176 for arrow retention.

Figure 10:
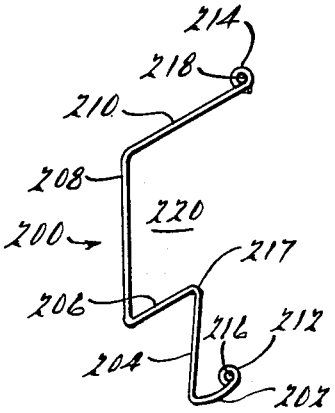
FIG. 10 is a perspective view of a fifth alternative embodiment of the present invention.
Figure 11:
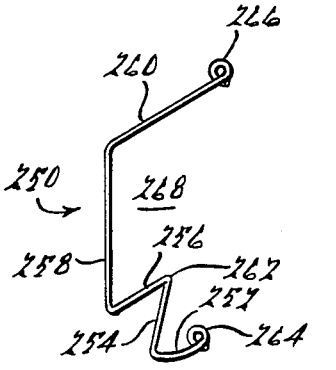
FIG. 11 is a perspective view of a sixth alternative embodiment of the present invention.
Figure 12:
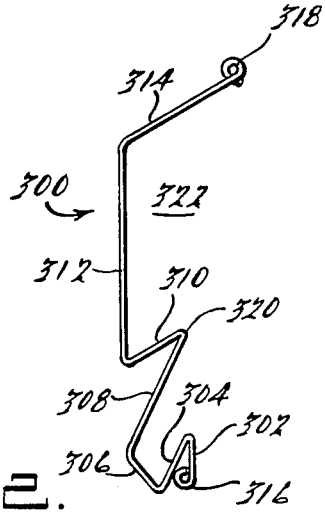
FIG. 12 is a perspective view of a seventh alternative embodiment of the present invention.

FIGS. 10–12 illustrate three further alternative embodiments of the present invention wherein each embodiment is made of wire. Arrow retainer 200 is adapted for use with bows having arrow rests such as arrow rest 18 shown in FIGS. 1 and 2. Arrow retainer 200 has lower horizontal leg 202, first vertical leg 204, middle horizontal leg 206, second vertical leg 208 and upper horizontal leg 210. Lower and upper horizontal legs 202 and 210 have respective ends 212 and 214 bent to form apertures 216 and 218 through which a threaded fastener can extend to fasten arrow retainer 200 to a bow. In use, arrow retainer 200 should be attached to an associated bow so that middle horizontal leg 206 is positioned with transition bend 217 proximate to the distal end of the arrow rest of the bow so that second leg 206 extends away from the bow with its upper surface generally coplanar with the upper surface of the arrow rest in a manner analogous to that of arrow retainer 22. Thus, an arrow can be guided along leg 206 onto the arrow rest. Legs 206, 208 and 210 cooperate with the associated arrow rest and bow to define an area 220 for arrow retention.

FIG. 11 illustrates arrow retainer 250 which is somewhat analogous in side elevation to arrow retainer 150 shown in FIGS. 8 and 9. Arrow retainer 250 has a lower leg 252 extending generally horizonally and upwardly, first vertical leg 254, middle horizontal leg 256, second vertical leg 258 and upper horizontal leg 260. Arrow retainer 250 should be mounted on an associated bow so that transition bend 262 between first vertical leg 254 and middle horizontal leg 256 is positioned proximate to the distal end of the associated arrow rest. Lower leg 252 and upper horizontal leg 260 has respective ends 264 and 266 bent to form apertures for mounting arrow retainer 250 on a bow. Legs 256, 258 and 260 cooperate with the associated arrow rest and bow to form area 268 for arrow retention.

FIG. 12 illustrates yet another alternative embodiment of the present invention indicated generally by the numeral 300. Arrow retainer 300 can be used with bows having arrow rests such as bow 102 shown in FIG. 6. Arrow retainer 300 has legs 302, 304, 306, 308, 310, 312 and 314. Legs 302 and 314 have respective ends 316 and 318 bent to form apertures for attaching arrow retainer 300 to a bow. Transition bend 320 should be positioned proximate to the distal end of the associated arrow rest with the upper surface of leg 310 extending generally coplanar with the upper surface of the arrow rest. Legs 310, 312 and 314 cooperate with the associated arrow rest and bow to form an area 322 for arrow retention.

While the above description constitutes the preferred embodiments of the present invention, it will be appreciated that the invention is susceptible to modification, variation and change without departing from the proper scope and fair meaning of the accompanying claims.

What is claimed is:

1. An arrow retainer in combination with an archery bow having a laterally extending arrow rest, said retainer adapted to retain an arrow in close proximity to said arrow rest said arrow retainer comprising:

a first leg extending generally laterally outwardly from said bow, said first leg positioned adjacent to and generally laterally aligned with the arrow rest, a second leg spaced from said arrow rest and joined to said first leg and extending generally upwardly from said first leg, a third leg joined to an upper end portion of said second leg and extending inwardly toward said bow, said first, second and third legs defining a substantially enclosed area and allowing limited free transverse movement of an arrow positioned within said enclosed area; and means for securing at least one of said legs to said bow.

2. The arrow retainer according to claim 1 wherein said third leg transitions at a junction to an out-turned fourth leg and said junction is spaced from said bow to define a gap which is less than the diameter of said arrow whereby said junction must be deflected in order to pass said arrow through said gap.

3. The arrow retainer according to claim 1 wherein said first leg includes a portion extending downwardly and a portion extending inwardly toward said bow.

4. An arrow retainer adapted to retain an arrow in close proximity with an arrow rest in combination with an archery bow, comprising:

a first substantially horizontal leg having a proximal end adapted to be mounted to said bow and a distal end, an arrow rest extending laterally from said first leg proximal mounting end to support an arrow, said arrow rest having a distal end, a second leg joining the distal end of said first leg and extending upwardly therefrom, a third leg joining said second leg at a point proximate to the distal end of said laterally extending portion of said arrow rest, and extending generally laterally away from said bow, said third leg aligned with the arrow rest such that the arrow may move laterally away from the bow onto said third leg, and a fourth leg joining said third leg and extending upwardly and laterally toward said bow, said fourth leg stopping movement of the arrow in a lateral direction and the bow, third and fourth legs defining a substantially enclosed area enabling movement of the arrow within the enclosed area.

5. The arrow retainer according to claim 4 wherein when said retainer is mounted to said bow, said fourth leg segment defines a gap between itself and said bow which is less than the diameter of said arrow.

6. The arrow retainer according to claim 4 wherein said third leg segment and said arrow rest are aligned such that said arrow is guided from contact with said third leg to contact with said arrow rest.

* * * * *

UNITED STATES PATENT AND TRADEMARK OFFICE

CERTIFICATE OF CORRECTION

PATENT NO. : 4,862,867

DATED : September 5, 1989

INVENTOR(S) : John M. Schmidt

It is certified that error appears in the above-identified patent and that said Letters Patent is hereby corrected as shown below:

On the title page:
Abstract, line 3, after "rest" insert --is described--.

Column 2, line 54, "aluminum steel" should be --aluminum, steel--.

Column 3, line 43, "150" should be --154--.

Column 4, line 24, "has" should be --have--.

Signed and Sealed this

Seventh Day of April, 1992

*Attest:*

HARRY F. MANBECK, JR.

*Attesting Officer*

*Commissioner of Patents and Trademarks*